US005906332A

United States Patent [19]

Greis et al.

[11] Patent Number: 5,906,332

[45] Date of Patent: May 25, 1999

[54] APPARATUS FOR THE TRANSFER OF A THREAD RUNNING ON A LOW PRESSURE AIR STREAM TO A ROTATING SPOOL

[75] Inventors: Dietmar Greis; Walter Mayer, both of Ingolstadt, Germany

[73] Assignee: Rieter Ingolstadt Spinnereimaschinenbau AG, Ingolstadt, Germany

[21] Appl. No.: 08/941,590

[22] Filed: Sep. 30, 1997

[30] Foreign Application Priority Data

Oct. 26, 1996 [DE] Germany ..... 196 44 592

[51] Int. Cl.[6] ..... B65H 54/00

[52] U.S. Cl. ..... 242/476.4

[58] Field of Search ..... 242/476.1, 476.4, 242/476.2

[56] References Cited

U.S. PATENT DOCUMENTS

| | | | |
|---|---|---|---|
| 3,964,690 | 6/1976 | Tauleigne . | |
| 4,105,165 | 8/1978 | Miyazaki et al. | 242/476.2 |
| 4,154,409 | 5/1979 | Reisser et al. . | |
| 4,158,444 | 6/1979 | Krauss . | |
| 4,164,330 | 8/1979 | Maassen et al. . | |
| 4,322,040 | 3/1982 | Gadeix et al. | 242/476.1 |
| 4,324,368 | 4/1982 | Inouye et al. . | |
| 4,466,575 | 8/1984 | Husges et al. . | |
| 4,565,331 | 1/1986 | Matsubara et al. | 242/476.1 |
| 4,687,148 | 8/1987 | Schuller et al. . | |
| 5,150,845 | 9/1992 | Colli et al. | 242/476.1 X |

FOREIGN PATENT DOCUMENTS

| | | |
|---|---|---|
| 0659674A1 | 6/1995 | European Pat. Off. . |
| 2374245 | 7/1978 | France . |
| 4424468A1 | 1/1996 | Germany . |
| 1534951 | 12/1978 | United Kingdom . |

*Primary Examiner*—Michael Mansen
*Attorney, Agent, or Firm*—Dority & Manning

[57] ABSTRACT

An apparatus is provided for the transfer of a thread (1) carried in a low pressure air stream being delivered to a rotating spool (7) with which a capture apparatus (4) runs in synchronism for the pick-up of the thread (1) which is set before it by a thread dispensing unit for this purpose. This thread dispensing unit exhibits two thread guides (31, 30) which hold the thread (1) at right angles to the travel path of the capture apparatus (4). Respectively, the first thread guide (31) forms a hold-back element which acts to restrain the thread (1) during the formation of a reserve winding in the spool border and to release the thread (1) for the formation of the normal winding. This first thread guide (31) is governed by a controllable drive (33), with the help of which, the open side of a thread guide groove (312) of this first thread guide (31) is pivotable out of a thread restraining position ($S_1$) into a thread release position ($S_2$). The second thread guide is also the opening (30) of a suction system.

11 Claims, 3 Drawing Sheets

APPARATUS FOR THE TRANSFER OF A THREAD RUNNING ON A LOW PRESSURE AIR STREAM TO A ROTATING SPOOL

BACKGROUND OF THE INVENTION

The present invention concerns an apparatus for the transfer of a thread running in low pressure air stream to a rotating spool.

In accordance with a known apparatus (DE-OS 2 543 986), the thread to be transferred to a rotating spool is held parallel to the outer surface of the spool by means of two thread guides of a thread handling means. This permits the thread to be seized by a thread capturing apparatus which rotates with the spool so that, subsequently, said thread can be wound to produce a coil. Additionally, a hold-back element is provided for the control of the number of reserve windings which are to be laid down at an end of the spool. For the cessation of forming reserve windings of this sort, the said hold-back device is movable in the direction of the middle of the spool. The apparatus is complex in design and in control, especially if it is adapted for automatic operation.

OBJECTS AND SUMMARY OF THE INVENTION

Thus, a purpose of the invention is, considering the above, to thoroughly improve the known apparatus, to the end that it becomes simpler in design and control.

Additional objects and advantages of the invention will be set forth in part in the following description, or may be obvious from the description, or may be learned through practice of the invention.

Since the first thread guide simultaneously forms the restraining element, this integral component of the thread dispensing unit is what makes the thread dispensing unit, hold-back element, and the control more compact. This comes about because the power drive for the first thread guide is arranged on the thread dispensing unit and does not have to be placed on a stationary piece, as, where the hold-back element was concerned, was previously the conventional situation.

By means of the use of a thread guidance groove with an open side, which restrains the thread in the first position and releases the thread in a second position, a particularly simple control of the first and second positions becomes possible.

Especially favorable is an improvement wherein the first thread guide is mounted pivotably on the second thread groove, since such a construction leads in a simple manner to a covering of the windings for the reserve coiling and thus assures against the possibility that said coils will not run off the spool.

A further simplification favorable to increased functionality is achieved through the design of the apparatus wherein the hold-back element is formed by a means of the first thread guide which is governed by a pneumatic cylinder or motor type controllable drive.

Through the conception an embodiment of the invention, the drive for the first thread guide allows itself to be positioned on the thread dispenser unit in a space saving way.

In an alternative embodiment of the invention, a frictionless support of the delivered thread from the opening of the suction line is attained in that the thread guidance groove of the first thread guide is installed parallel to the longitudinal axis of the rotating spool.

Advantageously, the apparatus is improved wherein a pivoting of the first thread guide is made possible without the necessity that, at a prior time, the thread must be withdrawn out of the zone of the rotating capture apparatus.

In order to be able to securely hold the thread during its dispensing as well as to achieve a release of the thread upon the completion of the building of a requisite number of reserve windings without difficulty, it is of advantage to design the present inventive apparatus in that the sidewall of the guide groove nearer the spool runs perpendicular to the pivoting axis of the first thread guide, and the sidewall remote from the spool is in a plane that increases in distance from a plane that intersects the pivoting axis of the first thread guide.

As already mentioned, it is by the first thread guide that the formation of the reserve winding is controlled. Regulating not only the number of windings on the spool end, but also the ability to control their exact arrangement, advantageously provides an improvement according to the objects of the invention wherein the two thread guides are adjustable relative to each other in a direction parallel to the longitudinal axis of the spool.

The apparatus in accordance with the invention is simple in construction, is compact, and easy to control. Moreover, the thread dispensing unit, improved by the invention, enables not only the delivery of the thread which is to be wound on the spool, but simultaneously serves to control the number of reserve windings formed on the end of said spool.

This simplified design of the apparatus and the coalescence of various functions in one and the same unit leads further to the advantage that such an apparatus allows itself to be easily retrofitted into already existing installations.

Example embodiments of the invention are described in more detail in the following, with the help of drawings.

DETAILED DESCRIPTION OF THE PREFERRED EMBODIMENTS

Figure 1:
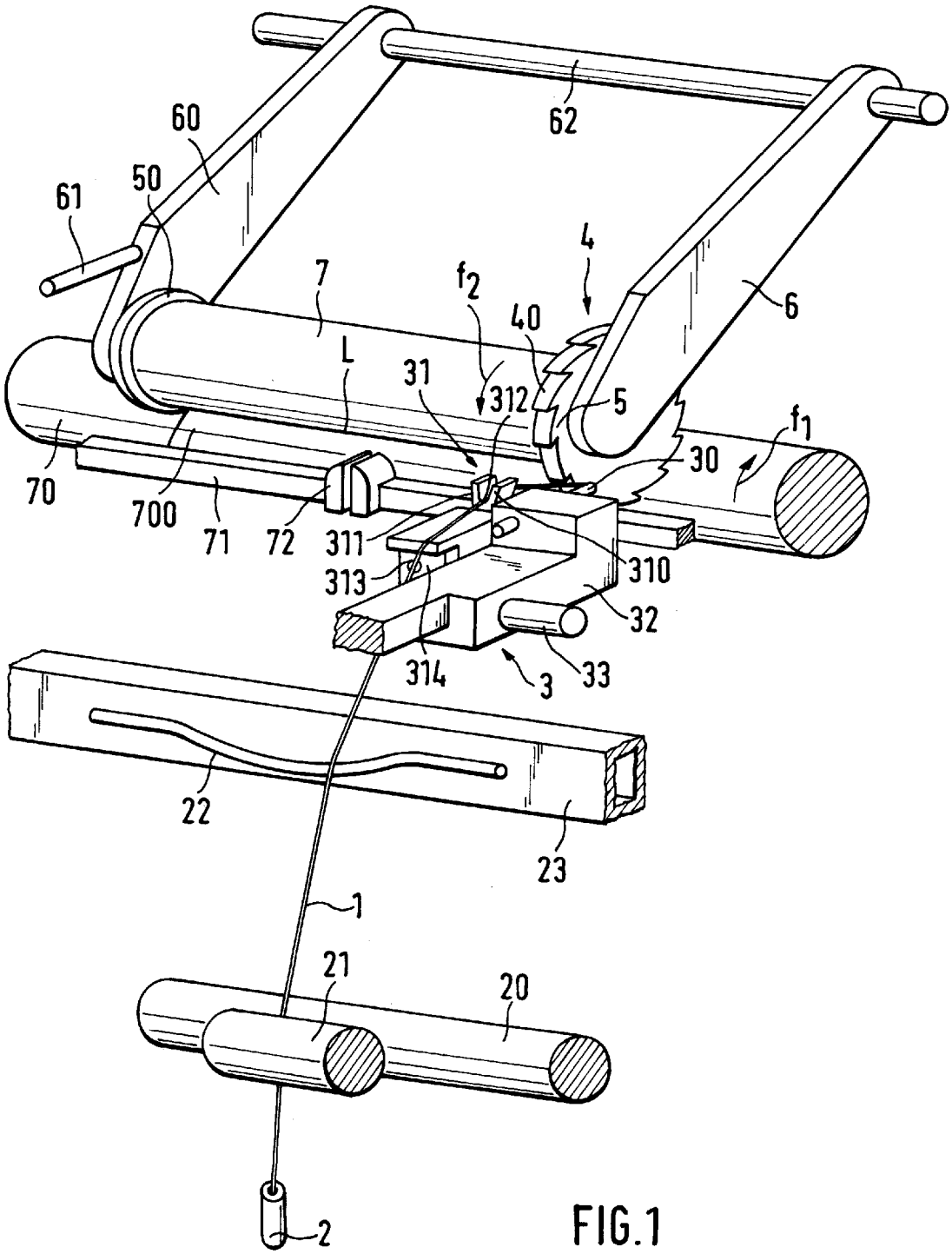
FIG. 1 is a perspective presentation of a spool winding apparatus with a thread dispensing unit in accordance with the invention.

Reference will now be made in detail to one or more presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment.

The invention can find application on various textile machines, where a running thread is transferred for winding on a spool, for instance, on a coiling machine. In the following, reference will be made to an open-end spinning machine, the spin-relevant components whereof will not be seen in the illustrations and are not necessary for an understanding of the invention.

The open-end spinning machine, which has been selected as an example, exhibits a pair of thread removal rollers (20, 21) for thread issuing from a thread removal tube 2. Proceeding from this, the thread goes over a thread tension balancing yoke 22, which is installed on the machine frame. The thread continues on to the opening 30 of a low pressure system (not shown). At that time, the thread passes thread guide 31, which, along with the opening 30, is secured on a common holder 32. In common with this and the opening 30 of the low pressure system, a thread dispensing unit is thus formed, with the help of which the thread, now entrained in low pressure air, can be dispensed to a capture device 4, which will be described later.

In respect to the course of the feed thread (1) which has now been removed from the low pressure tube opening 30, the thread guide 31 forms a first thread guide while the opening 30 is looked upon as a second thread guide. Between the two thread guides 31 and 30, is held a portion of the thread 1, which is to be transferred to the capture apparatus 4, and this portion of the thread is essentially parallel to the longitudinal axis A (see FIG. 2) of the spool 7. It is of no importance whether the spool 7 is cylindrical or conical in design.

The first thread guide 31 exhibits a pivotable arm 311 on the front side of which a thread guidance groove 312 is placed, in which said thread 1 can be guided. The side surface 310 of this arm 311 which faces the opening 30 forms a hold-back element for the thread 1, for use during the formation of a reserve winding W (for "W", see FIG. 3), as will be explained later.

The arm 311 is fixed by means of its axle 313 in the already mentioned holder 32. An additional arm 314 is found on the end of the axle 313 remote from arm 311, which, in a manner not shown, is connected to a drive unit. In accord with FIG. 1, as an exemplary embodiment, such a drive (pneumatic or hydraulic) is symbolized by a controllable cylinder 33, the piston of which is connected to this additional arm 314.

Figure 3:
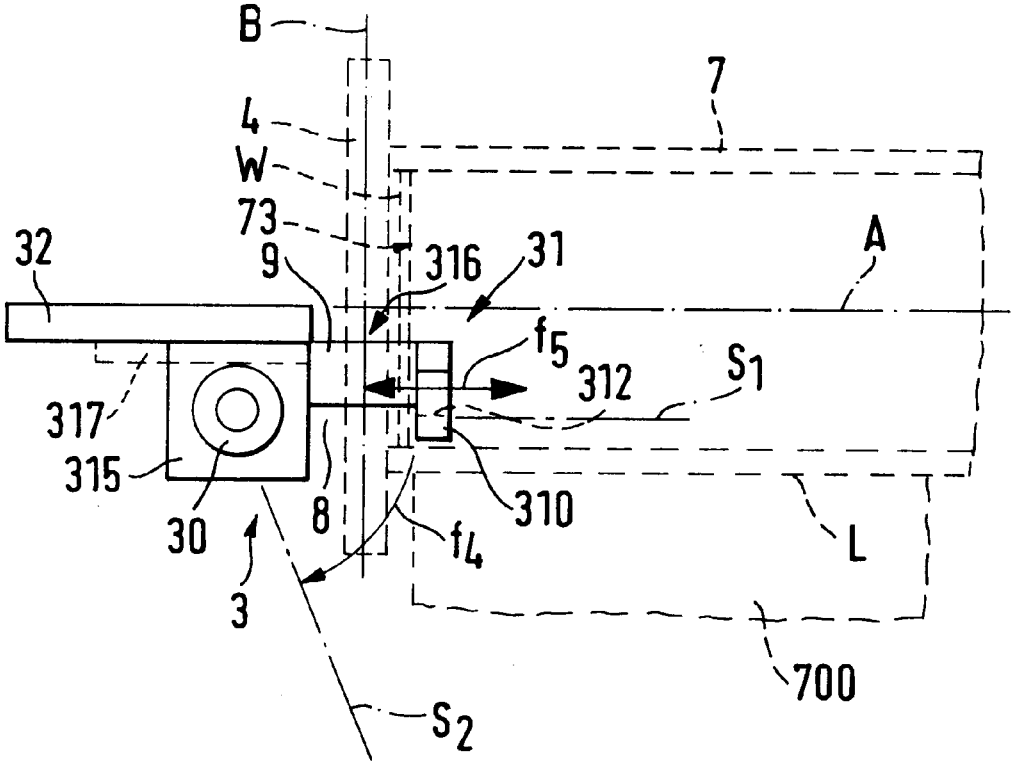
FIG. 3 is a schematic front view showing the two thread guides of the apparatus, wherein the first thread guide is set pivotable on the second thread guide.

The capture device 4 possesses, in accord with FIGS. 1 and 3, a plurality of capturing hooks 40 and is part of a spool plate 5, which is rotatably secured in spool arm 6. As FIG. 1 demonstrates, between the two spool arms 6 and 60, with the aid of two spool plates 5 and 50, a spool 7 is inserted, upon which the thread is to be wound. For automatic or manual lifting out of the movable spool arms 6 and 60, which are coupled with one another in a manner not shown, one of the two arms 6, 60, in accord with FIG. 1 arm 60, has been selected to possess a handle 61 on its free end. FIG. 1 shows further, that principally, one of the two spool plates 5 and 50, shown in FIG. 1 as the spool plate 5, is equipped with the capture apparatus 4.

Both spool arms 6 and 60 are affixed pivotably on a axle 62 wherein they, by means of appropriate individual design or by their bearing setting, are distanced one from the other to the extent, that an exchange of a full spool (not shown) for an empty spool 7 is made possible.

The spool 7, can be brought into contact with a drive roll 70, driven to rotate in the direction of the arrow $f_1$, which roll 70, as a rule, extends over a multiplicity of identical workplaces (open end spinning arrangements), situated next to one another.

Regarding this drive roll construction, only a part is to be inferred from FIG. 1. The drive roll 70 exhibits in the area of the spool 7, a section 700 of greater diameter, so that the spool 7 is not prevented by end plates 5 and 50 from having a uniform contact on drive roll 70.

Directly in front of the drive roll 70, there is found a traverse rod 71, which runs back and forth parallel to drive roll 70 and carries a traverse thread guide 72. The purpose thereof is that after the completed transfer of the thread 1 to the spool 7, and after the formation of a specified number of reserve windings W (see FIG. 3), the traverse guide 72 picks up the thread 1 to be able to lay said thread in traverse motion on the spool 7. In this way, a uniformly wound coil (not shown) can be formed.

In the following, the function of the previously described, designed apparatus is explained in greater detail.

After an empty spool 7 is set into its position for the formation of a new coil thereon, between the two spool arms 6 and 60, then the two arms 6 and 60 are lowered by appropriate manipulation of the operative arm 61, so that the spool 7 is rotated by the drive roll 70 (in the direction of the arrow $f_2$).

The thread 1, in a known and conventional manner and with the aid of a (not shown) service device has been previously spun and is now introduced into the thread dispensing unit. Simultaneously, by means of the withdrawal rolls 20 and 21, the thread 1 is extracted through the thread exit tube 2 of the open-end spinning apparatus. The thread is now continuously drawn out through the first thread guide 31 and the second thread guide 30, which said guide 30, in accordance with the embodiment shown in FIG. 1, has been designed as the opening of a low pressure device. The service device now swings the thread dispensing unit 3 out of an inactive position (not shown) in the direction of the capture apparatus 4, from which a capture hook 40 seizes the previously described thread portion. The said thread portion extends between the first thread guide 31 and the second thread guide which is also the opening 30.

This said thread portion runs essentially parallel to the longitudinal axis A of the spool 7 (see FIG. 2) and thereby also perpendicular to the circumferential track B of the capture hook 40.

The two spool plates 5 and 50 are rotationally, releasably locked with the spool 7 and hence take part in the rotation of the same. By this means, the capture device 4, which is part of the spool plate 5 is also driven.

Upon the rotation of the spool plate 5, the thread portion from the seized thread 1 from capture hook 40 of the capture device 4 moves into the contact line L between the spool 7 and the section 700 of the drive roll 70. This said thread portion, in respect to the capture hook 40 which engages the thread 1, forms the feed side of thread 1. Moreover, this feed side of the guided running thread 1 to be delivered to the spool 7 is drawn downward and thus comes into contact with the side surface (or edge 310) of the first thread guide 31, the side surface 310 of which faces the second thread guide (opening 30). The running thread 1 directed to the spool 7 is, based on the known design of the spool plate 5, clamped between this and the spool 7 and therefore secured. The thread 1 now runs under the tension which is generated by the higher circumferential speed of the spool 7 as compared to the circumferential speed of the thread removal rolls 20 and 21 (this is also the winding tension). The thread 1 runs with its feed side axial in direction to the middle of the spool 7, insofar as the thread guide 31 with its side surface 310, which holds back the thread 1 permits. The first thread guide 31 takes on accordingly the duty of a hold-back element, and holds back the thread during its winding onto the spool 7 in its end area between the spool plate 5 and the side surface 310, so that on the end of the spool 73, reserve windings W are created (see FIG. 3), which will be required later for the connection of the threads of two spools.

If sufficient reserve windings W have been formed, so that now the thread 1 should be given over for regular windings by the traverse guide 72, then, with power from hydraulic cylinder 33, lever 314 (see FIG. 1) pivots the first thread guide 31. As an alternate power source for this action, a stepwise motor 330 (see FIG. 2) may be used, the motor shaft of which (see FIG. 1, axis 313) also carries the lever 311 which pivots the first thread guide 31. The lever 311 of the first thread guide 31, which finds itself now in its transfer position, which simultaneously forms the thread hold-back position $S_1$ (see FIG. 2), is now pivoted (see arrow $f_3$) and comes finally into a thread release position $S_2$, in which the thread guide groove 312 can no longer hold back the thread, so that the thread, in an effort to find the shortest way to take between removal rolls 20, 21 and the spool 7, migrates toward the middle of the spool 7 and thus comes under the influence of the traverse zone and the traverse thread guide 72. This is designed conventionally as a self threading device and picks up the thread 1, which, from now on, will be laid by traversing from the traverse thread guide 72, so that now, regular windings will be formed on the self winding spool 7.

Figure 2:
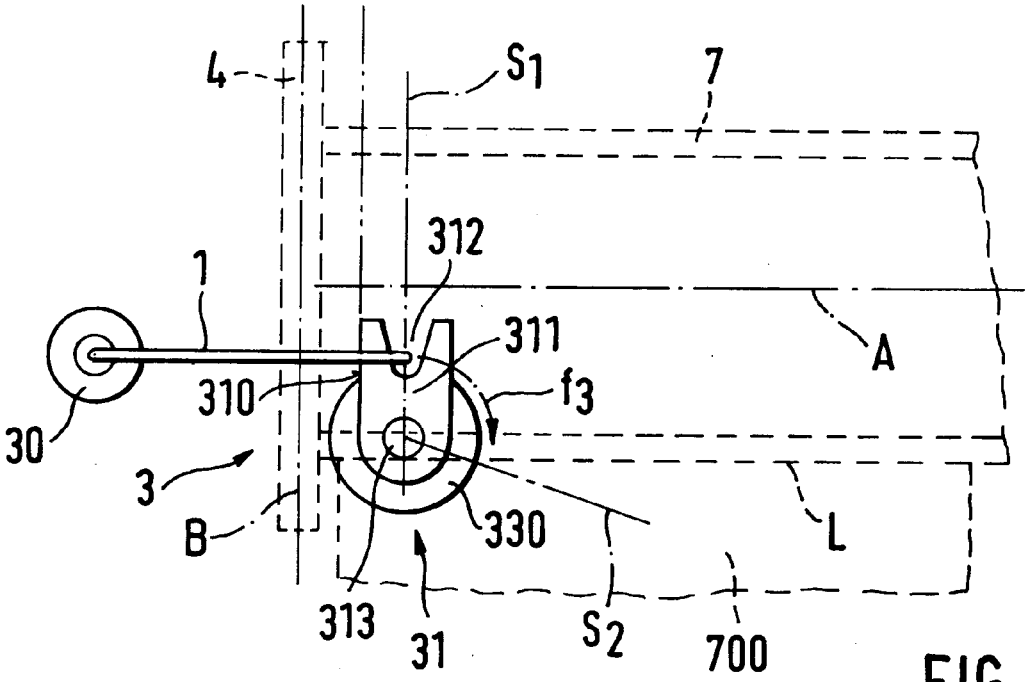
FIG. 2 is a schematic front view showing the two thread guides of a thread dispensing unit, wherein the first thread guide is configured with a pivoting axis, which, relative to the second thread guide, is arranged on the side facing the spool.

In the case of the embodiments shown in FIG. 1 and FIG. 2, the first thread guide 31 is supported on an axis 313, which is so arranged, that upon pivoting of the lever 311, the thread 1 is swung in the direction of the middle of the spool 7 and thereupon also in the direction of the transverse thread guide.72.

The invention is not limited to the above described embodiment, but can be changed in multiple ways, for instance, by the exchange of individual features for equivalents, or through other combinations. For instance, the pivoting or turning axes for the first thread guide can be chosen differently. Beyond this, the first thread guide can, for example, be in the form of tongs, whereby an arm of the tongs upon the changeover of the thread can be pivoted. FIG. 3 shows a variation of the previously described apparatus, in which the pivoting axis of the first thread guide 31 finds itself on the side turned toward the second thread guide (opening 30). If now, the first thread guide 31 pivots for the release of the thread 1 after the formation of the desired number of reserve windings W (FIG. 3, see arrow $F_4$), then the thread guide groove 312 comes into proximity not with the spool 7 nor with the traverse thread guide 72, but rather is moved further in the direction of the spool end 73. In doing this, the thread located on the side surface 310 of the thread guide 31 is forced in the direction of the spool end 73 and comes, on this account, to lie on the reserve windings W which are located there, which are thus covered over and so brought into safety when the full spool is taken out of the spool holders (spool arms 6 and 60) for storage and later reworking. If the first thread guide 31 reaches its release position $S_2$, then the thread 1 moves, because of the winding tension in the direction of the middle of the spool 7, is thereupon seized by the traverse thread guide 72 and is subsequently laid by traverse action.

The number of the desired reserve windings W can be duly determined with the help of a (not shown) control apparatus and also chosen on said control apparatus is the time span from the capturing the thread 1 by the capture apparatus 4 up to the pivoting of the first thread guide 31, which forms a hold-back element.

Figure 4:
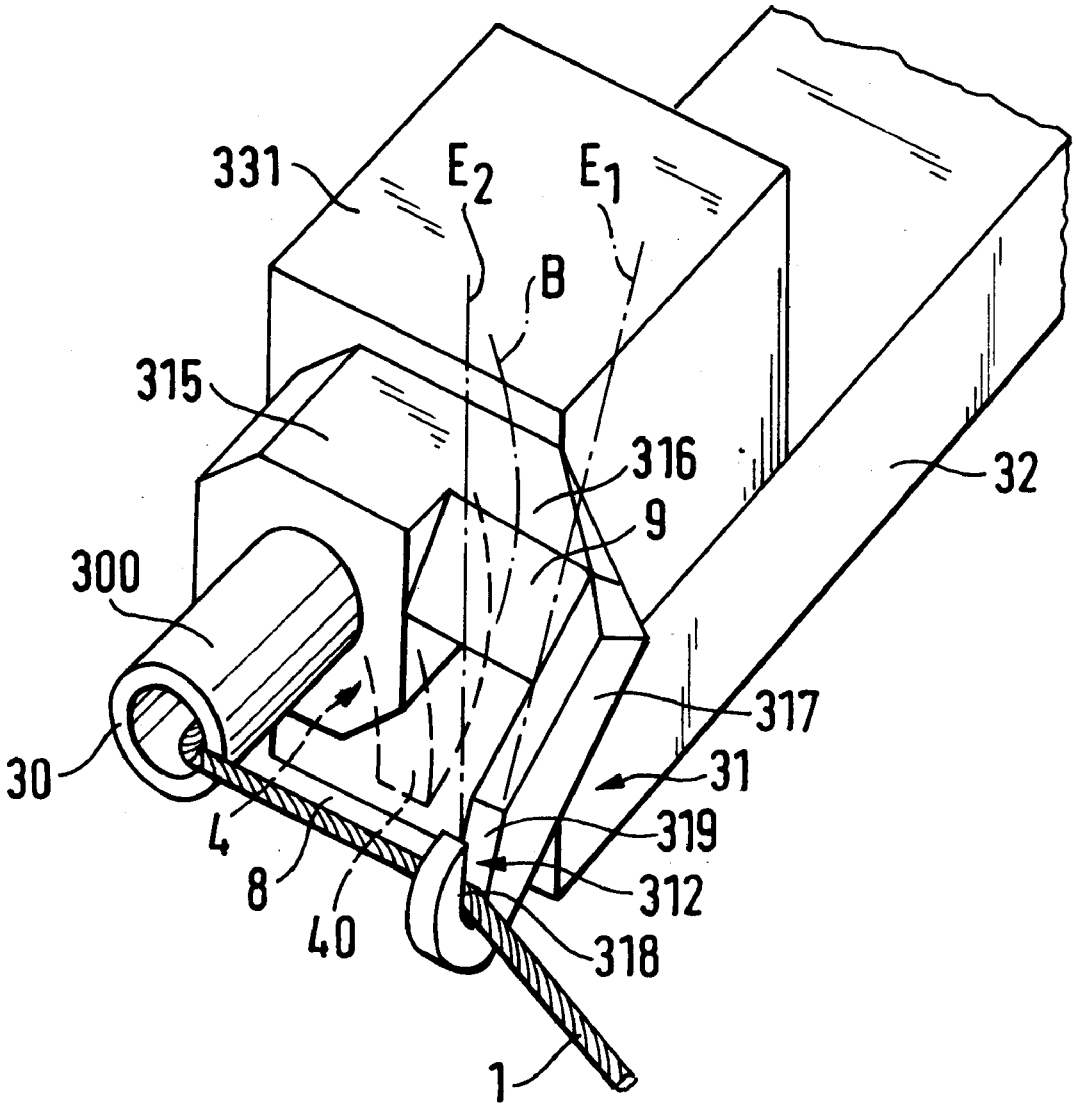
FIG. 4 is a perspective presentation showing a preferred design of the two thread guides.

The schematically presented apparatus of FIG. 3 is renewed in FIG. 4, this time in a perspective view. The opening 30 is in this case, arranged on the end of a tube section 300, which forms, at the same time, a hollow shaft designed as a drive shaft for a motor 331. Firmly secured to this hollow shaft 300, so that it must make all turning motions with said hollow shaft 300, is the first thread guide 31. This possesses a sheath-like retaining piece 315 which is pushed onto hollow shaft 300, from which an arm 316 extends radially from the hollow shaft 300. This arm 316 carries an angular extension 317 with the already mentioned thread guide groove 312, which, in the case of this embodiment, (contrary to what is shown in the embodiment of FIG. 1 and 2) does not extend perpendicularly to the longitudinal axis A of the spool 7, but instead of this, is arranged to be parallel thereto. This leads, for one thing, to an especially low friction of the supplied thread 1 running from the opening 30. And for another, this arrangement relieves the thread guide groove 312 from releasing the thread 1, when the first thread guide 31 reaches its thread release position $S_2$. FIGS. 2 and 3 show, that—in accordance with a preferred design of the described apparatus—the two thread guides, that is, the first thread guide 31 and the second thread guide designed as opening 30 or otherwise, relative to the direction of turning, (see arrow $f_2$ in FIG. 1) of the spool 7, find themselves in the area between the longitudinal axis A and the clamping line L which is between the spool 7 and the drive roll 70. The FIG. 2 and 3 show the thread dispensing unit 3 from its side facing the spool 7, so that there evolves therefrom, that the thread dispensing unit 3 in its depicted delivery position is found in the last quarter of the circumferential travel path of the capture apparatus 4 before the clamping line L. So that this capture apparatus 4 can pick up the presented thread 1, the two thread guides (31 and opening 30) form between them an opening for the partial incursion of the capture hooks 40 of the capture apparatus 4 (see FIG. 3 and 4).

These enter favorably into the area of the thread 1 which is to be picked up. In the case of a design of the apparatus in accord with the FIGS. 3 and 4, on this account the arm 316, which binds the first thread guide 31 with the second thread guide 30, possesses, a sloped surface 9, which is oriented essentially along the circumferential path B, or parallel to a tangent of said path B of the capture apparatus 4 and on the arm 316 or another, is provided the two thread guides 31 and (opening) 30 with an element for joining the two together.

The previously explained definition of the delivery position of the thread dispensing unit 3 in the last quarter of the circumferential path B, which quarter the capture apparatus 4 runs through before passing the contact line L between the spool 7 and the drive roll 70, has the advantage that the thread 1, during its being delivered to the contact line L (and a—not shown—thread dividing means in order to be able to split thread 1 after its transfer to the spool 7 between the capture apparatus 4 and the low pressure) is assuredly continually held in tension, since the capture apparatus 4 continually distances itself from the thread supply side more and more. Moreover, in the case of a design of the thread dispensing unit 3 in accord with FIGS. 3 and 4, the first thread guide 31 can be pivoted out of the thread hold-back position $S_1$ into the thread release position $S_2$ without the necessity that the thread dispensing unit 3 must be swung away from the capture apparatus 4, or pulled back therefrom, in order to clear the swinging area of the first thread guide 31.

As may be inferred from the FIGS. 2 and 3, the area in the end section of the spool 7, where the reserve windings are formed, is dependent upon the position of the first thread guide 31, that is especially its side surface 310. By means of adjustably moving the first thread guide 31 parallel to the longitudinal axis A of the spool 7, it is possible to immediately determine, where, in the end area of said spool 7 this reserve W should be formed.

The presentation of FIG. 3 indicates two possibilities for the installation of the first thread guide 31. For instance, the fastening piece 315 possesses a guide bar bracket in which the arm 316, with its extension 317, is secured with possibilities of sliding or being fixed in place (note the dotted line outline in FIG. 3).

In this way, the thread guide 31, is adjustable parallel to the longitudinal axis A of the spool 7 relative to the opening 30.

Another possibility is, that the tubular section 300 with the opening 30 can be slidably and affixably slipped into a (not shown) retention means in a guide bar bracket or the like in the holder 32. If this is done, the opening 30 can be adjusted parallel to the longitudinal axis A of the spool 7 (see arrow $f_5$) and carry with it the first thread guide 31 which is secured on the tubular piece 300. Thus both thread guides 30 and 31 are adjustable in common. The adjustability of the second thread guide (opening 30 or a thread guide of another design) can be of considerable meaning for the presentation of the thread 1 before the capture device 4 or a (not shown) thread splitter.

FIG. 4 illustrates, that the sidewall 318 of the thread guide groove 312 positioned nearer to spool 7 is oriented essentially perpendicular to the pivoting axis (opening 30) of the first thread guide 31. The more distant sidewall 319 of the thread guide groove 312, however, is generally located in a plane $E_1$. This plane $E_1$, distances itself increasingly from the base of the thread guide groove 312 in the direction of the open side of said groove from the pivoting axis (opening 30) of the first thread guide 31 which said axis vertically intersects the plane $E_2$. By this means, on the one hand is achieved that the thread 1, during its transfer to the capture apparatus 4 is securely held. On the other hand, The release of the thread 1 along the sidewall 319 which is inclined toward the plane $E_1$ is made easier following the attainment of the desired number of reserve winding W.

Even if prior to the second thread guide, a low pressure source was shown as opening 30, it is obvious that the second thread guide can be likewise constructed as a mechanical guiding element, which in a conventional way, would be placed before the opening 30.

It should be apparent to those skilled in the art that various modifications and variations can be made in the present invention without departing from the scope and spirit of the invention. It is intended that the present invention include such modifications and variations as come within the scope of the appended claims and their equivalents.

We claim:

1. An apparatus for transferring a thread in a textile machine that is carried in a low pressure air stream and delivered to a rotating spool, comprising:

a capture apparatus configured to rotate with said spool in a travel path and to capture said thread presented to said spool;

a thread dispensing unit system configured to hold said thread at essentially a right angle to said travel path of said capture apparatus at a position so that said capture apparatus can capture said thread as it rotates through its said travel path;

said thread dispensing unit further comprising a first and a second thread guide, said first thread guide forming a pivotal hold-back element to restrain said thread during formation of reserve windings at one end of said spool;

a controllable drive configured with said first thread guide to pivot said first hold-back element between a thread restraining position and a thread release position;

said second thread guide comprising a suction opening; and wherein upon delivery of said thread by said thread dispensing unit system at said position for capture by said capture apparatus, said first thread guide is disposed in an area adjacent said spool and said second thread guide is disposed in an area outside of said spool, and wherein said first and second thread guides tension said thread therebetween for capture by said capture apparatus.

2. The apparatus as in claim 1, wherein said first thread guide comprises a thread guide groove having an open side, said thread guide groove restraining said thread in said thread restraining position and releasing said thread out of said open side in said thread release position.

3. The apparatus as in claim 2, wherein said thread guide groove is disposed essentially parallel to a longitudinal axis of said rotating spool.

4. The apparatus as in claim 1, wherein said first thread guide is pivotally mounted on said second thread guide.

5. The apparatus as in claim 1, wherein said controllable drive is a pneumatic cylinder device.

6. The apparatus as in claim 1, wherein said controllable drive is a motor device.

7. The apparatus as in claim 1, wherein said suction opening is defined by a tubular piece held in a holder, said first thread guide rigidly fixed to said tubular piece, said tubular piece connected to said controllable drive wherein said tubular piece acts as a turntable to pivot said first thread guide.

8. The apparatus as in claim 1, further comprising a connecting element connecting said first and second thread guides, said connecting element comprising a surface element disposed so as to bisect a plane through said travel path of said capture apparatus.

9. The apparatus as in claim 1, wherein said first thread guide comprises a thread guide groove having an open side, said thread guide groove restraining said thread in said thread restraining position and releasing said thread out of said open side in said thread release position, said thread guide groove having a first sidewall nearer to said spool that is essentially perpendicular to a pivoting axis of said first thread guide, and a second sidewall remote from said spool disposed in a plane that increases in distance from said first sidewall towards said open side of said thread guide groove.

10. The apparatus as in claim 1, wherein said first and second thread guides are adjustable relative to each other in a direction parallel to a longitudinal axis of said spool.

11. The apparatus as in claim 1, wherein said first thread guide is adjustable in common with said second thread guide.

* * * * *